United States Patent [19]

Paul

[11] 3,943,745

[45] Mar. 16, 1976

[54] PIERCING AND COINING APPARATUS

[76] Inventor: William A. Paul, 1808 Parkside Blvd., Toledo, Ohio 43607

[22] Filed: Mar. 27, 1975

[21] Appl. No.: 562,790

[52] U.S. Cl. ..... 72/335; 72/328; 72/332; 72/432; 72/464

[51] Int. Cl.[2] ..... B21D 28/00

[58] Field of Search ..... 72/335, 333, 332, 328, 72/327, 326, 324, 464, 348, 432, 455, 456, 397, 334; 83/613, 627, 639, 681, 685, 686, 465; 29/432, 432.1, 432.2; 269/37, 40; 113/1 F, 121 R

[56] References Cited

UNITED STATES PATENTS

| | | | |
|---|---|---|---|
| 1,920,303 | 8/1933 | Grotnes | 72/327 |
| 2,432,804 | 12/1947 | Bieske | 72/334 |
| 2,700,407 | 1/1955 | Trimble | 72/333 |
| 2,772,735 | 12/1956 | Wakelee | 83/685 X |
| 3,146,749 | 9/1964 | Heinle | 113/1 F |
| 3,494,168 | 2/1970 | Williamson | 72/335 |
| 3,776,016 | 12/1973 | Quinn et al. | 72/327 |

*Primary Examiner*—C. W. Lanham
*Assistant Examiner*—James R. Duzan
*Attorney, Agent, or Firm*—Allen D. Gutchess, Jr.

[57] ABSTRACT

Apparatus for piercing and coining a metal workpiece is provided. The apparatus includes a punch and a back-up die which accomplish the piercing, and a coining die located around the punch and movable with respect thereto to accomplish the coining. The punch and coining die are driven by a hydraulic ram which enables the overall apparatus to be relatively compact as compared to most heavy-duty dies and is adaptable for use at a station in a machine which also performs other operations on the workpiece. The workpiece is held precisely in position by a plurality of locators including adjustable fingers which contact and position the workpiece.

10 Claims, 4 Drawing Figures

PIERCING AND COINING APPARATUS

This invention relates to apparatus for piercing and coining a workpiece.

The apparatus according to the invention includes a piercing die or punch around which is a coining die so that the piercing and coining operations are accomplished with one stroke. The dies are driven by a hydraulic ram connected directly thereto so that the overall piercing and coining apparatus is relatively compact, especially when compared with the large floor-mounted dies heretofore used to operate on relatively thick metal workpieces. The compact size of the apparatus enables it to be incorporated into a single overall machine which also performs other operations on the workpiece with the dies being mounted for horizontal movement and capable of operating on an automatically-fed workpiece.

The apparatus also includes means for locating the workpiece relative to the punch and coining die more accurately. Each locator includes a supporting shank and a locating finger carried thereby which can be adjusted so as to precisely fit with the desired surface of the workpiece to be located. The adjustable finger requires a minimum amount of machining or "barbering" of the surface of the finger which is to be engaged with the workpiece.

It is, therefore, a principal object of the invention to provide improved apparatus for piercing and coining metal workpieces.

Many other objects and advantages of the invention will be apparent from the following detailed description of a preferred embodiment thereof, reference being made to the accompanying drawings, in which.

Figures 1, 2:
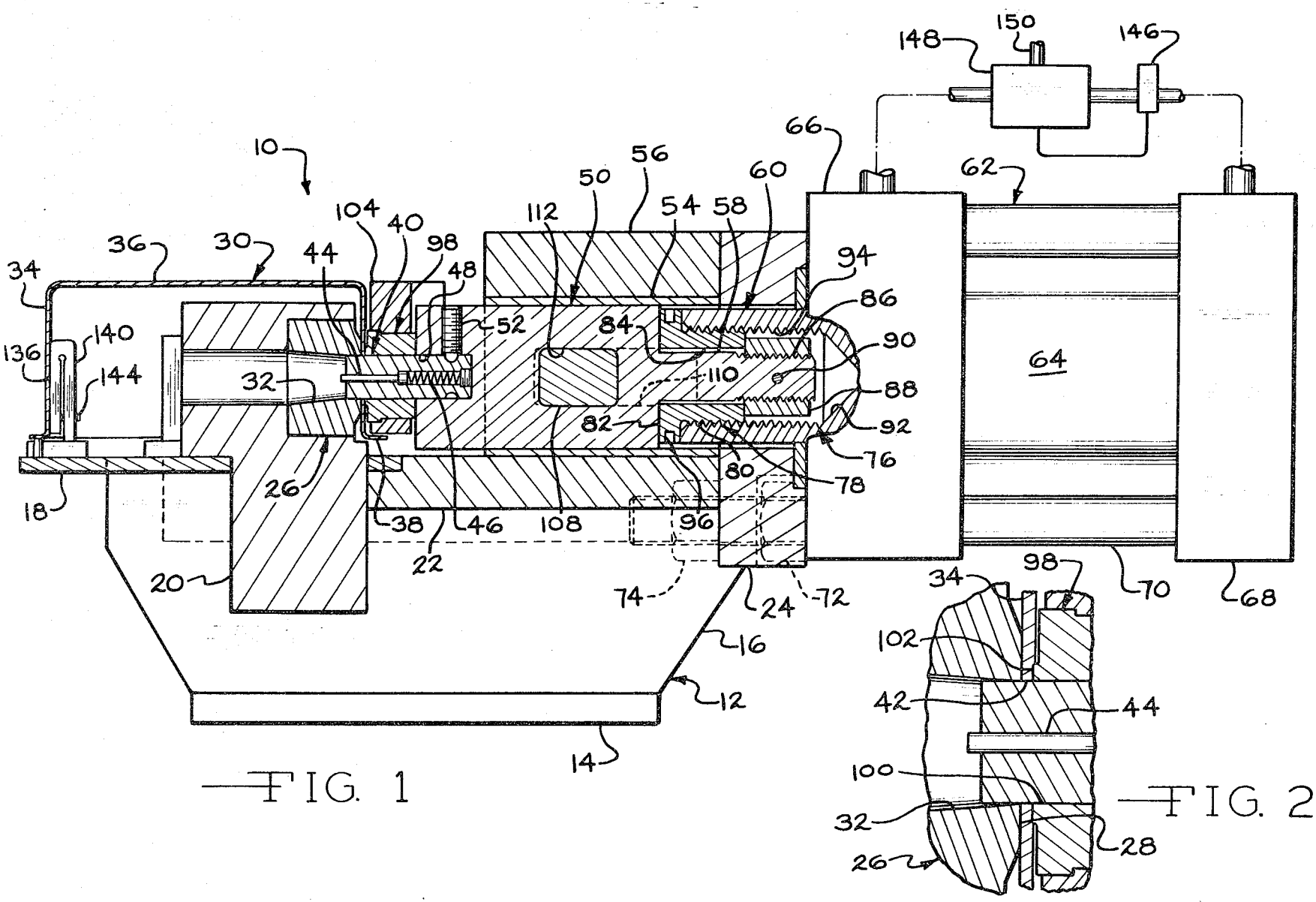
FIG. 1 is a somewhat schematic side view, with most of the parts broken away and shown in central, longitudinal cross section, of apparatus embodying the invention.
FIG. 2 is a fragmentary, enlarged, detail view of a portion of the apparatus of FIG. 1.

Referring to the drawings, piercing and coining apparatus indicated at 10 includes a main frame 12 comprising a bottom plate 14 and two thick, vertically-extending plates 16. The frame supports a workpiece platform or table 18, a back-up die support 20, a ram bushing base 22, and a hydraulic cylinder mounting block 24. The support 20 holds a female or back-up die 26 having an annular supporting surface 28 (FIG. 2) for a workpiece 30 and having a central passage 32 of circular cross section. The workpiece 30 is shown in the form of a heavy-duty compressor housing and includes a side wall 34, an end wall 36, and a flange 38.

On the side of the workpiece opposite the back-up die 26 is a punch 40 which forms a circular hole 42 in the side wall 34 when it is forced through the wall and into the passage 32 of the back-up die 26. A shedder pin 44 is located centrally in the punch 40 and is backed up by a spring 46. The shedder pin strips the slug from the side wall 34 when the hole 42 is formed. The punch 40 is located in a recess 48 of a ram 50 and is held in the recess by a suitable retaining screw 52. The ram 50 is slidably supported in a large bushing 54 which is located between the base 22 and an upper supporting block 56 in front of the mounting block 24.

The ram 50 has a rearwardly-extending shank 58 which is connected into a piston rod 60 extending forwardly from a hydraulic cylinder 62 comprising a cylindrical housing 64, a forward end cap 66, and a rear end cap 68. These are held together by threaded rods 70 and nuts 72. The rods 70 also extend through the mounting block 24 and are held by nuts 74 to support the hydraulic cylinder 62 from the mounting block 24.

The ram shank 58 is connected to the piston rod 60 by a self-aligning coupling indicated at 76. The coupling includes a threaded bushing 78 having a threaded portion 80 and a flange 82 with a central bore 84 which is slightly larger than the shank 58. The shank 58 has a threaded end 86 on which is threaded a sleeve 88 which is held by a pin 90. The sleeve 88 thereby holds the bushing 78 on the shank 58. The piston rod 60 has a large recess 92 with internal threads 94 into which the bushing 78 is threaded, being turned by a spanner wrench or the like engaged in recesses 96 in the flange 82 of the bushing. With this arrangement, the ram 50 can be securely fastened to the piston rod 60 and yet the coupling 76 enables smooth operation of the ram 50 even if the piston rod and the ram are misaligned by as much as 0.010 inch.

Figure 3:
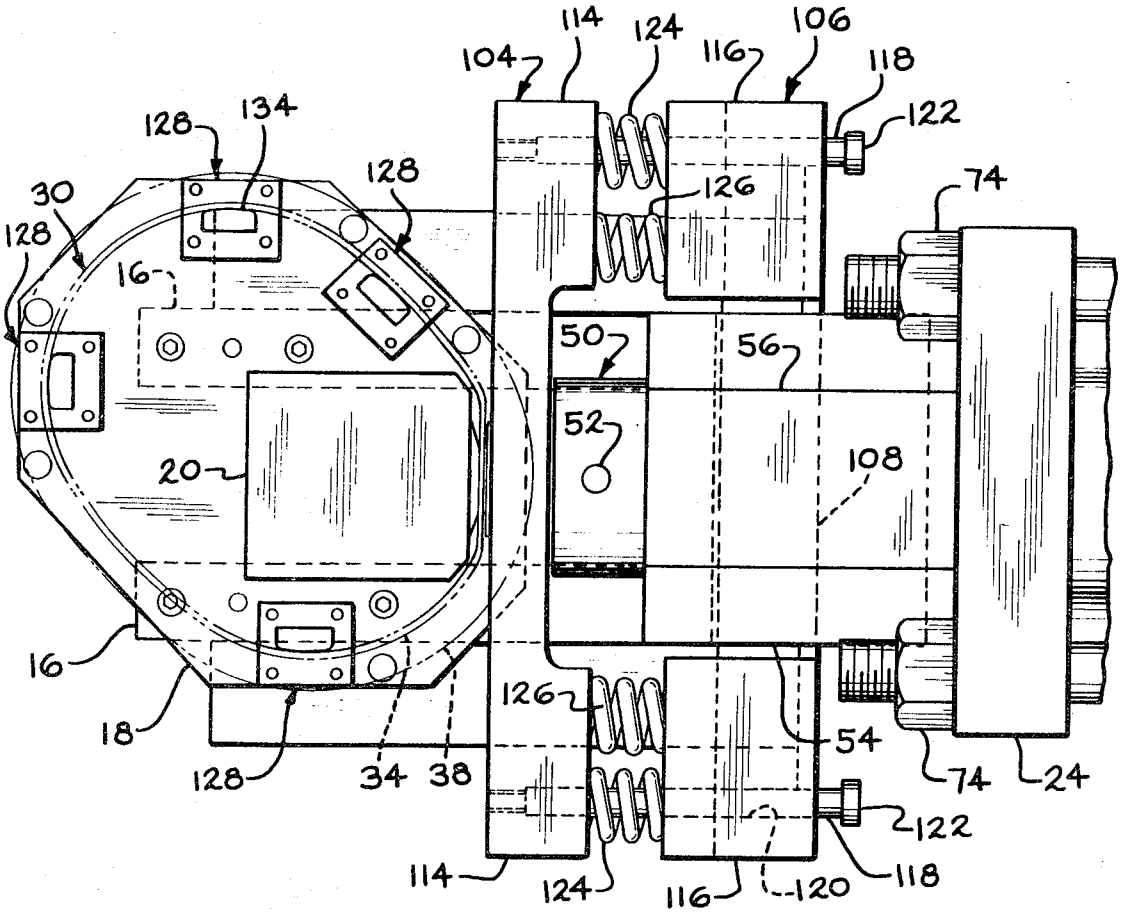
FIG. 3 is a fragmentary plan view of the apparatus of FIG. 1 which is shown in section.

As shown particularly in FIGS. 1 and 2, a coining die 98 is located around the punch 40, having a central bore 100 through which the punch 40 extends. The coining die 98 has a forwardly-extending annular ridge 102 which performs the coining operation on the side wall 34 around the hole 42 formed therein by the pucch 40. The coining die 98 is mounted in a forward stripper bar 104 (also FIG. 3) and preferably extends slightly beyond the rear surface of the bar 104 so as to be directly engagable by the front face of the ram 50. The stripper bar 104 is located forwardly of a rear stripper bar 106 having a central web portion 108 which extends through slots 110 in the bushing 54 and also extends centrally through a passage 112 in the ram 50 as to move therewith. Outer enlarged end portions 114 and 116 of the stripper bars 104 and 106 are connected by rods 118 which are affixed to the portions 114 of the forward stripper bar 104 and extend through passages 120 of the enlarged portions 116 of the rear stripper bar 106. The rods 118 have heads 122 which abut the rear surfaces of the bar 106 when the bars 104 and 106 are in their maximum spaced positions. The bars are urged apart by heavy compression springs 124 and 126.

Figure 4:
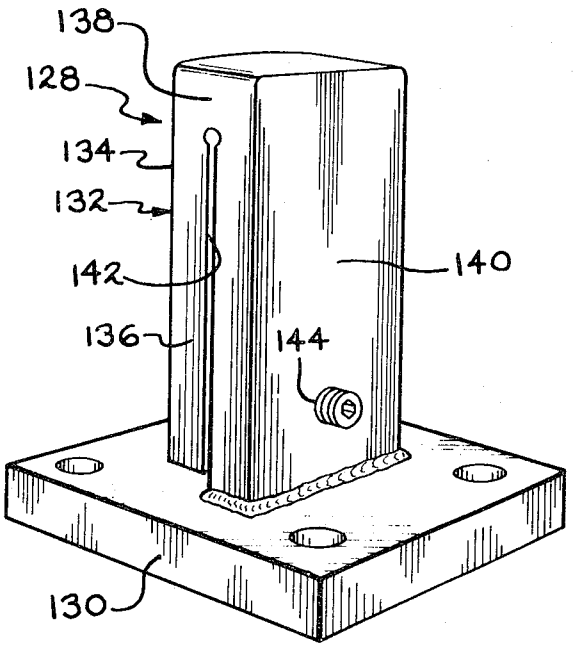
FIG. 4 is a view in perspective of a locator for the workpiece used with the apparatus of FIGS. 1–3.

The compressor housing or workpiece 30 is precisely located relative to the punch and dies by four locators 128 at appropriate positions around the platform 18 to precisely position the housing when it is inserted thereover. Each of the locators includes a base 130 (FIG. 4) and an upright post 132 and are all basically the same. However, each is of a particular shape to accurately fit with a particular portion of the housing 30 so as to precisely position it for the piercing and coining operation. Heretofore, a contoured surface 134 on the post 132 had to be precisely formed to properly fit with the inner surface of the housing 30. This operation, known as "barbering" or "shaving", required considerable time to produce the proper contour. However, the locator 128 has the surface 134 adjustable so as to reduce the fitting time from as much as two days to as little as five minutes. To accomplish this, the contoured surface 134 is provided on an adjustable finger 136 having its upper end connected by a structurally-integral web 138 to an upright shank 140. In practice, the finger 136, the web 138, and the shank 140 are formed from the post 132 by producing a slot 142 therein, the upper end of which is rounded to prevent cracking, and by cutting off the lower end of the finger 136 above the base 130. The shank 140 has a threaded bore formed therein which receives an adjusting screw 144. The adjusting screw 144 extends through the shank and abuts the rear surface of the finger 136, as shown in FIG. 1. By turning the screw 144 in, the spacing of the shank 140 and the finger 136 can be increased; by turning the screw 144 out, the spacing can be decreased up to the normal unstressed thickness of the slot 142. The screw thereby can be turned to adjust the position of the finger 136 to control the position of the contoured surface 136 so that minimum shaving or machining is required to provide the ultimate shape therefor.

In the operation of the apparatus 10, the housing 30 is placed over the locators 128 in the desired position. With the piston rod 60 fully retracted, the punch 40 will be spaced from the side wall 34 of the workpiece 30 and the coining die 98 will also be spaced from the side wall 34 with the forward surface thereof in front of the forward end of the punch 40. When fluid is supplied to the blind end of the cylinder 62, the piston rod 60 will move forwardly, with the punch and the coining die retaining their positions until the annular ridge 102 of the coining die 98 contacts the outer surface of the side wall 34. Further, movement of the piston rod 60 and the ram 50 then causes the springs 124 and 126 to compress so that the coining die retains its position against the surface 34 but the punch 40 is moved forwardly and through the surface to form the hole 42 by virtue of the direct force thereon by the ram 50.

When the forward end of the ram 50 engages the rear surface of the coining die 98 behind the bar 104, it also applies a direct force to the coining die 98 agaist the side wall 34 to form the coined annular area around the hole 42. This force continues until the pressure in the blind end of the cylinder 62 reaches a particular maximum. A pressure switch 146 (FIG. 1) then actuates a four-way valve 148 to reverse flow and direct hydraulic fluid from a supply line 150 to the rod end of the cylinder 62 to retract the ram 50. By this time, the shedder pin 44 will have ejected the slug from the side wall into the passage 32 of the back-up die 26.

As the ram 50 retracts, it directly retracts the punch 40. However, the coining die 98 stays in position by virtue of the force of the springs 124 and 126, even though the force of the springs diminishes. When the heads 122 of the connecting rods 118 abut the rear surface of the enlarged portions 116 of the rear stripper bar 106, the forward stripper bar 104 will then retract, along with the coining die 98. By this time, the punch 40 will have been completely withdrawn from the side wall 34 of the housing 30. After full retraction, the housing 30 is removed, another positioned on the locators 128, and the cycle repeated.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. Apparatus for piercing and coining a workpiece comprising a main frame, means on said frame for locating the workpiece, a back-up die, means for supporting said die on said frame on one side of the workpiece, a ram on the other side of the workpiece, a punch carried by said ram and extending toward the workpiece, a coining die in front of said ram and positioned around a portion of said punch, a shedder pin carried centrally in said punch and extending forwardly thereof, means for resiliently connecting said ram and said coining die, said coining die being spaced from said ram prior to said coining die contacting the workpiece and means for moving said ram toward and away from the workpiece.

2. Apparatus according to claim 1 characterized by said means for locating the workpiece comprises an upright shank, means forming a contour surface adjacent said shank and yieldably connected to said shank, and means for adjusting said contour means relative to said shank.

3. Apparatus according to claim 2 characterized by said shank and said contoured surface means being connected at the upper ends thereof.

4. Apparatus according to claim 3 characterized by said adjusting means comprises a screw threadably mounted in said shank and having an end engagable with said contour surface means.

5. Apparatus according to claim 1 characterized by said moving means for said ram comprises a hydraulic cylinder carried by said frame and a piston rod extending forwardly of said cylinder and connected to said ram.

6. Apparatus according to claim 5 characterized by said piston rod being connected to said ram by a self-aligning coupling.

7. Apparatus for piercing and coining a metal workpiece comprising a main frame, means carried by said frame for locating the workpiece, a back-up die, means for supporting said back-up die on one side of the workpiece, a ram, bushing means slidably carrying said ram for movement toward and away from said back-up die on the side of the workpiece opposite said back-up die, a punch affixed to said ram and directed toward said back-up die, said punch being movable by said ram through the workpiece and into said back-up die, a coining die having a bore through which said punch extends, a first bar in which said coining die is affixed, said bar being located in front of said ram and extending to the sides thereof, said ram being effective to move said coining die against the workpiece when said ram has moved a distance toward the workpiece, a second bar carried by said ram and movable therewith, resilient means connected between said first bar and said second bar and effective to maintain said coining die against the workpiece around said punch as said ram is retracted from the workpiece, a hydraulic cylinder carried by said frame, a piston rod extending from said cylinder and connected to said ram, means for supplying hydraulic fluid under pressure to both ends of said cylinder, and pressure-sensing means for changing the supply of fluid from the blind end of said cylinder to the rod end thereof when the pressure of the fluid at the blind end reaches a pre-set value.

8. Apparatus according to claim 7 characterized by a self-aligning coupling connecting said piston rod and said ram.

9. Apparatus according to claim 7 characterized by at least one connecting rod connecting said first bar and said second bar to limit the distance between said first bar and said second bar and to cause said second bar to retract said first bar after said ram has moved a distance away from the workpiece.

10. Apparatus according to claim 7 characterized by said means carried by said frame for locating the workpiece comprises an upright shank, a finger having a contoured surface connected at an end portion to said shank, and means for moving said finger toward and away from said shank.

* * * * *